US008517779B2

(12) United States Patent
Zhang et al.

(10) Patent No.: US 8,517,779 B2
(45) Date of Patent: Aug. 27, 2013

(54) ELECTRICAL TERMINAL

(75) Inventors: Hong Tu Zhang, Guang-Dong (CN); Ping-Chih Chen, New Taipei (TW); Ming-Chiang Chen, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 93 days.

(21) Appl. No.: 13/345,662

(22) Filed: Jan. 6, 2012

(65) Prior Publication Data

US 2013/0178116 A1 Jul. 11, 2013

(51) Int. Cl.
*H01R 11/22* (2006.01)

(52) U.S. Cl.
USPC ..... 439/862

(58) Field of Classification Search
USPC ..... 439/862
See application file for complete search history.

(56) References Cited

U.S. PATENT DOCUMENTS 4,431,252 A * 2/1984 Cairns et al. ..... 439/862
5,769,673 A * 6/1998 Ohta et al. ..... 439/852
5,915,988 A * 6/1999 Bitsch et al. ..... 439/398
6,126,496 A * 10/2000 Shinozaki ..... 439/862
6,616,485 B2 * 9/2003 Harasawa et al. ..... 439/630
6,676,456 B1 * 1/2004 Horng ..... 439/862
7,131,875 B2 * 11/2006 Kodaira et al. ..... 439/862
7,163,415 B2 * 1/2007 Miyoshi ..... 439/404
7,220,152 B2 * 5/2007 Jeong ..... 439/862
8,052,428 B2 * 11/2011 Tsao ..... 439/66
8,206,188 B1 * 6/2012 Zhang et al. ..... 439/862
8,298,021 B2 * 10/2012 Huang et al. ..... 439/862
2006/0276085 A1 * 12/2006 Ma et al. ..... 439/862
2007/0224890 A1 * 9/2007 Chien et al. ..... 439/862

* cited by examiner

*Primary Examiner* — Gary F. Paumen
(74) *Attorney, Agent, or Firm* — Cheng-Ju Chiang

(57) ABSTRACT

An electrical terminal has a soldering plate, a propping plate extending upward and rearward from a front end of the soldering plate, a resilient arm bending upward and then extending forward from a rear end of the soldering plate, and a pressing portion of inverted-V shape connected with a front end of the resilient arm and defining a mouth between a front arm and a rear arm thereof. A top end of the propping plate bends forward and downward to form a lower hook tail stretched in the mouth, resisting against an inner side of the front arm, and apart from an inner turning of the pressing portion. A bottom end of the front arm bends rearward and upward to form an upper hook tail hooking the lower hook tail with a free end thereof resisting against an outer side of the propping plate.

3 Claims, 2 Drawing Sheets

ELECTRICAL TERMINAL

BACKGROUND OF THE INVENTION

1. Field of the Invention

The present invention generally relates to an electrical terminal, and more particularly to an electrical terminal adapted for being connected to ground.

2. The Related Art

With the development of electronic technology, electronic products are more and more miniaturized. An electrical terminal is often used in the electronic product for being connected to ground so as to reduce electromagnetism radiation of the electronic product. However, a restraining slice is often assembled to the electrical terminal and used to restrain a resilient arm of the electrical terminal so as to avoid deformation of the electrical terminal, when a large quantity of the electrical terminals are stacked together in storage. After the electrical terminal is assembled in the electronic product, the restraining slice is taken away to set free the resilient arm so as to ensure a use quality of the electrical terminal. As a result, this needs to take a lot of manpower and material resources, so that reduces production efficiency of the electrical terminal and increases production cost of the electrical terminal.

SUMMARY OF THE INVENTION

An object of the present invention is to provide an electrical terminal. The electrical terminal has a soldering plate placed levelly, a propping plate extending upward from a front end of the soldering plate and slanted rearward in the process of extending upward, a resilient arm formed by a rear end of the soldering plate bending arcuatedly upward and then extending levelly forward, and a pressing portion connected with a front end of the resilient arm. The front end of the resilient arm is apart from the propping plate. The pressing portion shows a substantially inverted-V shape from a lateral view and defines a mouth between a front arm and a rear arm thereof. A top end of the propping plate bends forward and downward to form a lower hook tail stretched in the mouth of the pressing portion. The lower hook tail resists against an inner side of the front arm of the pressing portion, and is apart from an inner side of the rear arm and an inner turning of the pressing portion. A bottom end of the front arm bends rearward and then extends slantwise upward to form an upper hook tail hooking the lower hook tail with a free end thereof resisting against an outer side of the propping plate. The pressing portion can be pressed downward under the cooperation of the upper hook tail and the propping plate, and the lower hook tail and the front arm of the pressing portion until the lower hook tail resists against the inner turning of the pressing portion.

As described above, the electrical terminal is formed by curving a long rectangular metal plate, and utilizes the cooperation of the lower hook tail and the upper hook tail, the lower hook tail and the pressing portion, and the upper hook tail and the propping plate to simplify the structure of the electrical terminal and allows a large quantity of the electrical terminals to be stacked together in storage easily. This saves a lot of manpower and material resources, improves production efficiency of the electrical terminal and reduces production cost of the electrical terminal.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
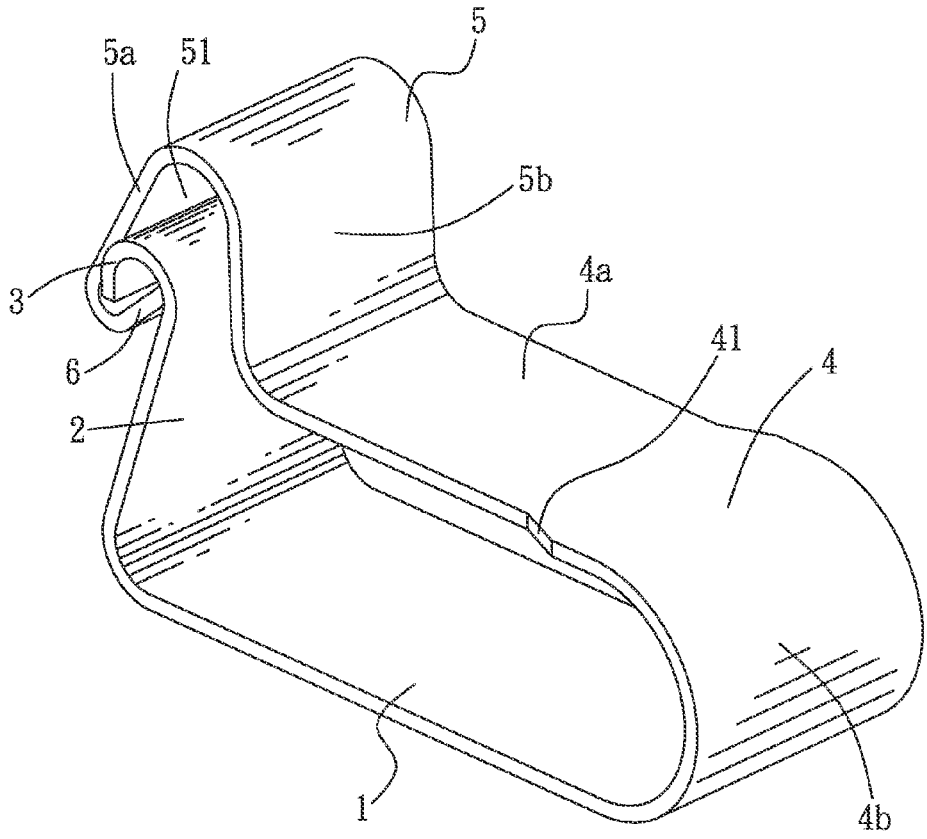
FIG. 1 is a perspective view of an electrical terminal according to an embodiment of the present invention.
Figure 2:
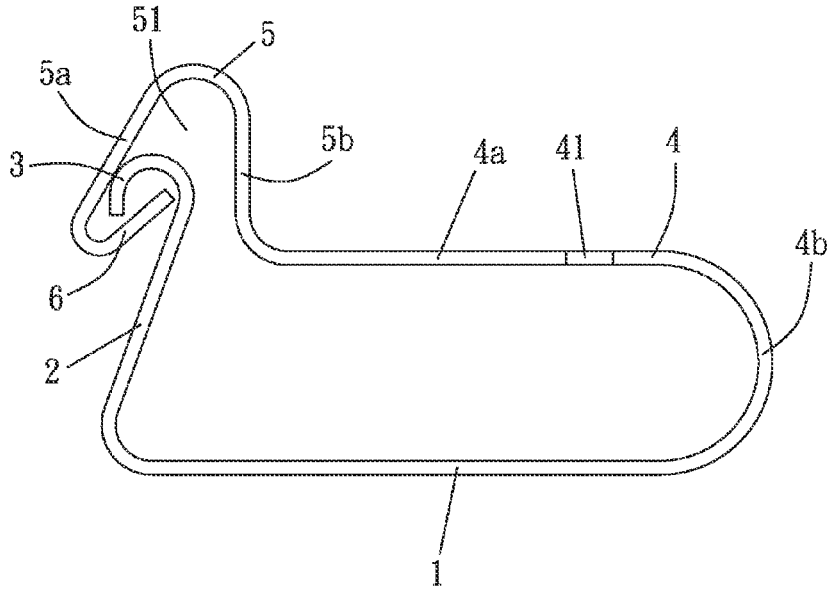
FIG. 2 is a lateral view of the electrical terminal of FIG. 1.

Referring to FIG. 1 and FIG. 2, an electrical terminal in accordance with an embodiment of the present invention is adapted for being connecting to ground, and is formed by curving a long rectangular metal plate. The electrical terminal has a soldering plate 1 placed levelly, a propping plate 2 extending upward from a front end of the soldering plate 1 and slanted rearward in the process of extending upward, a resilient arm 4 formed by a rear end of the soldering plate 1 bending arcuatedly upward and then extending levelly forward, and a pressing portion 5 connected with a front end of the resilient arm 4.

The front end of the resilient arm 4 is apart from the propping plate 2. The pressing portion 5 shows a substantially inverted-V shape from a lateral view and defines a mouth 51 between a front arm 5*a* and a rear arm 5*b* thereof. A top end of the propping plate 2 bends forward and downward to form a lower hook tail 3 stretched in the mouth 51 of the pressing portion 5. The lower hook tail 3 resists against an inner side of the front arm 5*a* of the pressing portion 5, and is apart from an inner side of the rear arm 5*b* and an inner turning of the pressing portion 5. A bottom end of the front arm 5*a* bends rearward and then extends slantwise upward to form an upper hook tail 6 hooking the lower hook tail 3 with a free end thereof resisting against an outer side of the propping plate 2. A junction of a level arm 4*a* and an arcuated arm 4*b* of the resilient arm 4 oppositely protrudes sideward to form two fastening shoulders 41.

Figure 3:
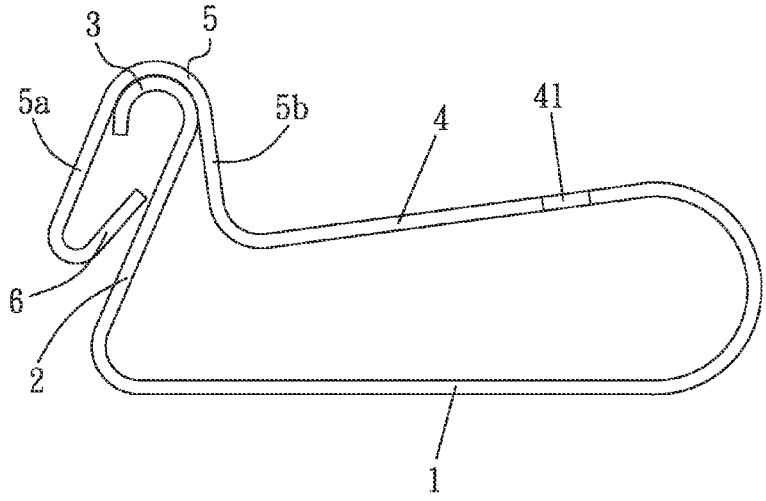
FIG. 3 is a lateral view showing a working state of the electrical terminal of FIG. 1 being pressed downward by an external force.

Referring to FIGS. 1 to 3, in use, the pressing portion 5 is pressed downward by an external force to make the upper hook tail 6 slide slantwise downward along the outer side of the propping plate 2 and further press the propping plate 2 rearward. Relatively, the lower hook tail 3 slides slantwise upward along the inner side of the front arm 5*a* in the mouth 51, until the lower hook tail 3 resists against the inner turning of the pressing portion 5 to avoid an excessive pressure on the pressing portion 5.

As described above, the electrical terminal formed by curving the long rectangular metal plate utilizes the cooperation of the lower hook tail 3 and the upper hook tail 6, the lower hook tail 3 and the pressing portion 5, and the upper hook tail 6 and the propping plate 2 to simplify the structure of the electrical terminal and allows a large quantity of the electrical terminals to be stacked together in storage easily. This saves a lot of manpower and material resources, improves production efficiency of the electrical terminal and reduces production cost of the electrical terminal.

What is claimed is:

1. An electrical terminal, comprising:

a soldering plate placed levelly;

a propping plate extending upward from a front end of the soldering plate and slanted rearward in the process of extending upward, a top end of the propping plate bending forward and downward to form a lower hook tail;

a resilient arm formed by a rear end of the soldering plate bending arcuatedly upward and then extending levelly forward, a front end of the resilient arm being apart from the propping plate; and a pressing portion connected with the front end of the resilient arm, the pressing portion showing a substantially inverted-V shape from a lateral view and defining a mouth between a front arm and a rear arm thereof, a bottom end of the front arm bending rearward and then extending slantwise upward to form an upper hook tail;

wherein the lower hook tail stretches in the mouth of the pressing portion with the upper hook tail and the lower hook tail hooking each other, the lower hook tail resists against an inner side of the front arm of the pressing portion, and is apart from an inner side of the rear arm and an inner turning of the pressing portion, a free end of the upper hook tail resists against an outer side of the propping plate, the pressing portion can be pressed downward under the cooperation of the upper hook tail and the propping plate, and the lower hook tail and the front arm of the pressing portion until the lower hook tail resists against the inner turning of the pressing portion.

2. The electrical terminal as claimed in claim 1, wherein a junction of a level arm and an arcuated arm of the resilient arm oppositely protrudes sideward to form two fastening shoulders.

3. The electrical terminal as claimed in claim 1, wherein the electrical terminal is formed by curving a long rectangular metal plate.

* * * * *